US005810193A

United States Patent [19]

Gordon

[11] Patent Number: 5,810,193

[45] Date of Patent: Sep. 22, 1998

[54] SCONCE FOR CONCEALING A THERMOSTAT

[76] Inventor: Paul W. Gordon, 4900 Normandy La., Memphis, Tenn. 38117

[21] Appl. No.: 769,303

[22] Filed: Dec. 19, 1996

[51] Int. Cl.[6] ..... B65D 6/12

[52] U.S. Cl. ..... 220/476; 220/664; 220/745; 211/86

[58] Field of Search ..... 220/476, 664, 220/603, 662, 745, 367.1; 211/86, 87

[56] References Cited

U.S. PATENT DOCUMENTS

| | | | |
|---|---|---|---|
| 5,924 | 11/1848 | Gage | 312/245 |
| D. 265,800 | 8/1982 | Butera | D10/57 |
| D. 281,147 | 10/1985 | Khemka | D10/57 |
| D. 288,413 | 2/1987 | Tanaka | D10/57 |
| D. 312,216 | 11/1990 | Nadzak | D10/57 |
| D. 313,560 | 1/1991 | Kummunsalo | D10/57 |
| 1,243,059 | 10/1917 | Friesleben | 211/90 |
| 1,673,531 | 6/1928 | Roedding | 220/481 |
| 1,806,295 | 5/1931 | Kinnard | 220/476 |
| 1,953,037 | 3/1934 | Ash | 220/476 |
| 2,045,507 | 6/1936 | Woodruff | 73/151 |
| 2,070,221 | 2/1937 | Whittier | 73/118 |
| 2,078,993 | 5/1937 | Barbier | 73/118 |
| 2,549,414 | 4/1951 | Bonnell | 311/107 |
| 2,580,103 | 12/1951 | Keller | 45/36 |
| 2,691,693 | 10/1954 | Lewis | 220/604 |
| 2,812,102 | 11/1957 | Calplinger | 220/367.1 |
| 4,138,889 | 2/1979 | Fraschin | 73/356 |
| 4,146,258 | 3/1979 | Andruchin | 220/604 |
| 4,793,267 | 12/1988 | Birillo | 108/152 |
| 4,961,612 | 10/1990 | Howard | 312/37 |
| 5,025,949 | 6/1991 | Adkins et al. | 220/481 |
| 5,044,285 | 9/1991 | Wolfe, III | 108/152 |
| 5,228,760 | 7/1993 | Rydell | 312/211 |
| 5,370,249 | 12/1994 | Harvey | 211/189 |
| 5,379,912 | 1/1995 | Wolf | 220/481 |
| 5,443,173 | 8/1995 | Emery et al. | 220/481 |

FOREIGN PATENT DOCUMENTS

| | | |
|---|---|---|
| 1160493 | 4/1958 | France . |
| 801590 | 7/1958 | United Kingdom . |

*Primary Examiner*—Joseph M. Moy
*Attorney, Agent, or Firm*—John M. Harrison

[57] ABSTRACT

A sconce for mounting on a wall and concealing a thermostat provided on the wall to prevent viewing and undesired manipulation of the thermostat. In a first preferred embodiment the sconce is characterized by a sconce bracket which is mounted on the wall above the thermostat and includes a generally semicircular bracket panel which extends perpendicularly from the wall, parallel to the floor. A quarter globe-shaped sconce panel is removably mounted on the sconce bracket and abuts the wall below the sconce bracket to enclose and conceal the thermostat. The sconce bracket and bracket panel are each provided with multiple air vents for allowing ambient air to enter the sconce and contact the concealed thermostat. A decorative object such as a flower arrangement may be supported and displayed on the bracket panel. In a second preferred embodiment the sconce panel is provided with a lockset for locking the sconce panel on the sconce bracket.

20 Claims, 4 Drawing Sheets

SCONCE FOR CONCEALING A THERMOSTAT

BACKGROUND OF THE INVENTION

FIELD OF THE INVENTION

This invention relates to thermostats and more particularly, to a sconce for mounting on a wall and concealing a thermostat provided on the wall to prevent undesired viewing and manipulation of the thermostat. In a first preferred embodiment the sconce includes a sconce bracket for mounting on the wall above the thermostat. The sconce bracket is provided with a semicircular bracket panel which extends perpendicularly from the wall, parallel to the floor. A curved, quarter globe-shaped sconce panel formed with a pair of spaced panel tab acceptors is removably mounted on the sconce bracket, the panel tab acceptors receiving respective frame tabs shaped in the sconce bracket. The sconce panel abuts the wall, enclosing and concealing the thermostat. Both the sconce bracket and the bracket panel are provided with multiple air slots or vents for facilitating a flow of ambient air through the sconce in contact with the thermostat. The bracket panel is adapted for supporting a decorative object such as a flower arrangement. In a second preferred embodiment, a lockset is mounted in the bracket for selectively engaging the sconce panel and locking the sconce panel on the bracket to prevent undesired removal of the sconce panel.

One of the problems frequently encountered in homes or offices is the undesired appearance and/or manipulation or tampering of thermostats, resulting in undesirable temperature fluctuation in the building. The sconce of this invention provides an attractive, aesthetically-pleasing cover for easily mounting on a wall and effectively concealing a thermostat and/or locking and enclosing the thermostat as a deterrent to undesired manipulation of the thermostat and to conceal the thermostat from view.

DESCRIPTION OF THE PRIOR ART

Various thermostats and thermometers for controlling and measuring temperatures, respectively, are known in the art. U.S. Pat. No. 2,045,507, dated Jun. 23, 1936, to Henry S. Woodruff, describes an "Instrument Panel For Closed Liquid Heaters" which is readily convertible, for indicating either the water level and steam pressure for steam heating service or water temperature and hydrostatic pressure for hot heating service. U.S. Pat. No. 2,070,221, dated Feb. 9, 1937, to Horace R. Whittaker, details a "Thermometer" for application to the doors or walls of stoves and range ovens or other articles such as cooking utensils. The temperature-indicating mechanism of the thermometer is actuated by a thermo-responsive metallic strip. U.S. Pat. No. 2,078,993, dated May 4, 1937, to Emile Barbier, discloses a "Watertight Portable Thermometer", in which the core of a spiral bi-metallic thermometer is pivoted to the center of a thin metal cup enclosed in a case having a transparent plastic top. The needle of the thermometer travels over a dial engraved or printed on the bottom of the cup, responsive to changes in ambient temperature. U.S. Pat. No. 4,138,889, dated Feb. 13, 1979, to Mario Fraschini, describes a "Ready-Reading, Liquid-Crystal-Display Thermometer" characterized by a liquid-crystal strip thermometer adapted for clinical use. The melting point of the liquid crystals provided in each of several display points of the strip equals the correspondingly possible temperatures of an easily-accessible area of the patient's body. U.S. Design Pat. No. 265,800, dated Aug. 17, 1982, to Charles Butera, et al, illustrates a "Novelty Thermo-Responsive Liquid Crystal Indicating Device". U.S. Design Pat. No. 281,147, dated Oct. 29, 1985, to Kailash C. Khemka, illustrates a "Thermochromic Finger Thermometer". U.S. Design Pat. No. 288,413, dated Feb. 24, 1987, to Yoshihisa Tanaka, illustrates a "Thermometer For Vehicles". U.S. Design Pat. Ser. No. 312,216, dated Nov. 20, 1990, to John E. Nadzak, illustrates a "Digital Aquarium Thermometer", and U.S. Design Pat. No. 313,560, dated Jan. 8, 1991, to Pentti M. Kummunsalo, illustrates a "Meter For Monitoring Temperature".

Other pertinent patents include U.S. Pat. No. 1,243,059, dated Oct. 16, 1917, to Friesleben; U.S. Pat. No. 2,269,551, dated Jan. 13, 1942; U.S. Pat. No. 2,549,414, dated Apr. 17, 1951, to Bonnell; U.S. Pat. 2,580,103, dated Dec. 26, 1945, to Keller, et al; U.S. Pat. No. 4,793,267, dated Dec. 27, 1988, to Birillo; U.S. Pat. No. 4,961,612, dated Oct. 9, 1990, to Howard; U.S. Pat. No. 5,044,285, dated Sep. 3, 1991, to Wolfe; U.S. Pat. No. 5,228,760, dated Jul. 20, 1993, to Rydell; U.S. Pat. No. 5,370,249, dated Dec. 6, 1994, to Harvey, et al; U.S. Pat. No. 5,924, dated Nov. 14, 1848, to Gage; U.S. Pat. No. 2,269,551, dated Jan. 13, 1942, to Powell; French No. 1,160,493; and British No. 801,590.

It is an object of this invention to provide a sconce for mounting on a wall and concealing a thermostat provided on the wall to prevent viewing and/or undesired manipulation of the thermostat.

Another object of this invention is to provide a decorative, esthetically-pleasing sconce for preventing undesired viewing and/or manipulation of a wall thermostat, which sconce is characterized by a sconce bracket mounted on a wall above the thermostat and including a semicircular bracket frame extending perpendicularly from a flat bracket frame in parallel relationship with respect to the floor. The sconce further includes a rounded, quarter globe-shaped sconce panel for removably mounting on the sconce bracket and abutting the wall to enclose and conceal the thermostat.

Still another object of this invention is to provide a thermostat sconce characterized by a slotted sconce bracket for mounting on a wall above a thermostat and including a semicircular bracket frame extending from a flat bracket frame in perpendicular relationship with respect to the wall, which sconce further includes a sconce panel characterized by a slotted, hollow quarter globe for removably mounting on the sconce bracket and including spaced panel notches or tab acceptors for removably receiving corresponding frame tabs shaped in the sconce bracket.

Yet another object of this invention is to provide a decorative sconce for concealing a thermostat, which sconce is characterized by a sconce bracket for mounting on a wall above the thermostat and including a horizontal, slotted top plate or frame and a semicircular bracket panel or frame extending from the top plate in perpendicular relationship with respect to the wall and which sconce further includes a slotted, hollow, quarter globe-shaped sconce panel for mounting on the sconce bracket and abutting the wall to conceal the thermostat and a lockset mounted in the sconce bracket for removably locking the sconce panel on the sconce bracket.

Another object of this invention is to provide an attractive, aesthetically-pleasing, slotted sconce for concealing a thermostat provided on a wall, which sconce includes a flat, horizontal upper surface for supporting and displaying decorative objects such as plants, flowers and vases.

Still another object of this invention is to provide a sconce for concealing a thermostat, including a sconce bracket for mounting on the wall above the thermostat and receiving a quarter globe-shaped sconce panel which abuts the wall to enclose and conceal the thermostat. The sconce bracket includes a slotted vent box and floor and the rounded sconce panel is provided with multiple air vents or slots for allowing ambient air to flow through the sconce and maintain the thermostat substantially at room temperature.

SUMMARY OF THE INVENTION

These and other objects of the invention are provided in a decorative sconce for concealing a wall-mounted thermostat to prevent viewing and/or undesired manipulation or tampering of the thermostat, which sconce, in a first preferred embodiment, includes a sconce bracket for mounting on the wall above the thermostat and having a semicircular bracket panel with a slotted vent box and floor extending perpendicularly from the sconce bracket. Further included is a quarter globe-shaped, hollow sconce panel for removably mounting on the sconce bracket and abutting the wall to enclose and conceal the thermostat. The vent box and floor of the bracket panel are adapted for supporting decorative objects such as plants, flowers, vases and the like. In a second preferred embodiment a lockset is mounted in the sconce bracket and extends through the bracket to the sconce panel for removably locking the sconce panel on the bracket. Both the bracket panel and sconce panel are provided with multiple air vents for allowing ambient air to circulate through the sconce, contact the thermostat and thus maintain the thermostat substantially at room temperature.

BRIEF DESCRIPTION OF THE DRAWINGS

The invention will be better understood by reference to the accompanying drawings, wherein.

DESCRIPTION OF THE PREFERRED EMBODIMENTS

Figure 1:
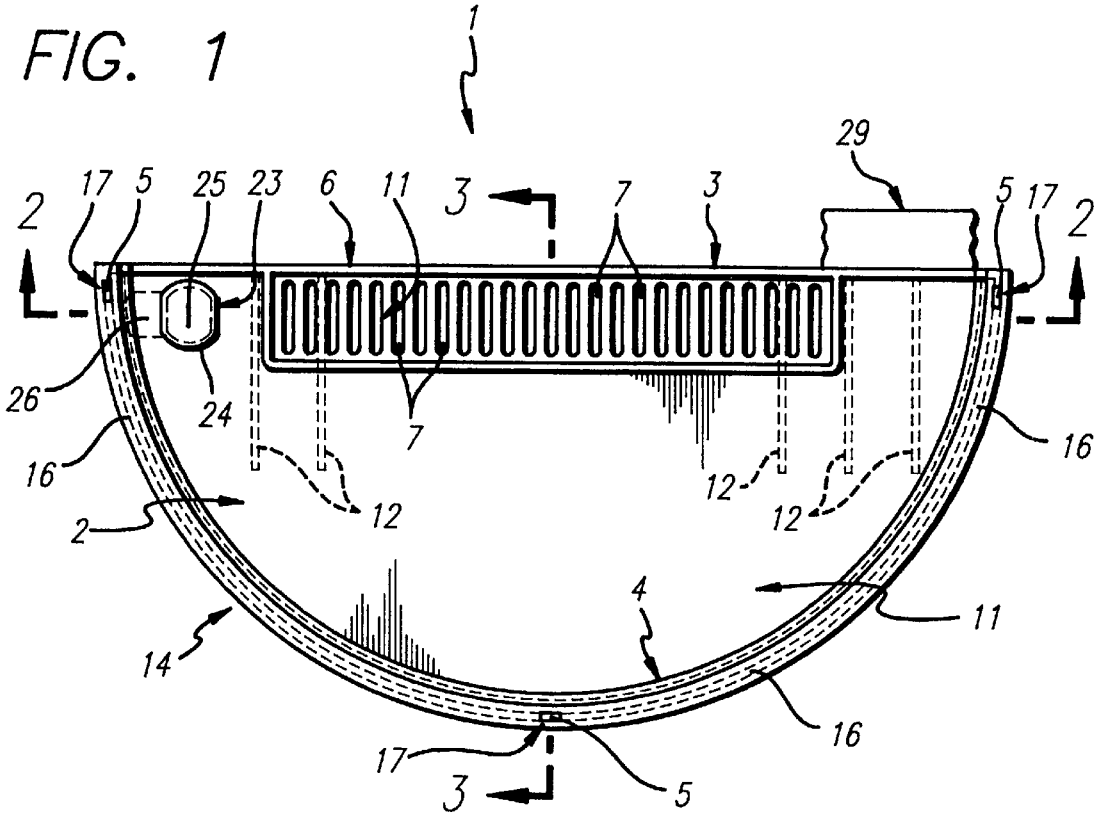
FIG. 1 is a top view of a first preferred embodiment of the sconce of this invention mounted on a wall and concealing a wall-mounted thermostat.
Figure 2:
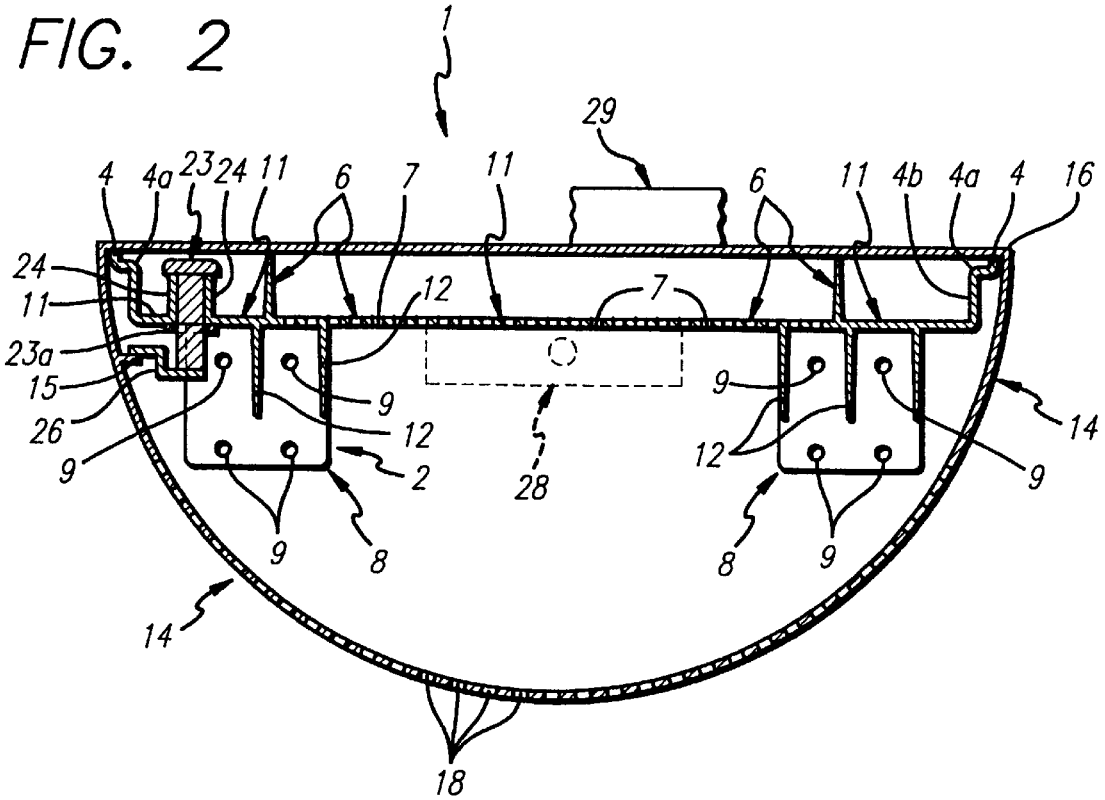
FIG. 2 is a sectional view, taken along line 2—2 of the sconce illustrated in FIG. 1, more particularly detailing the bracket element for removably receiving the sconce panel element.
Figure 3:
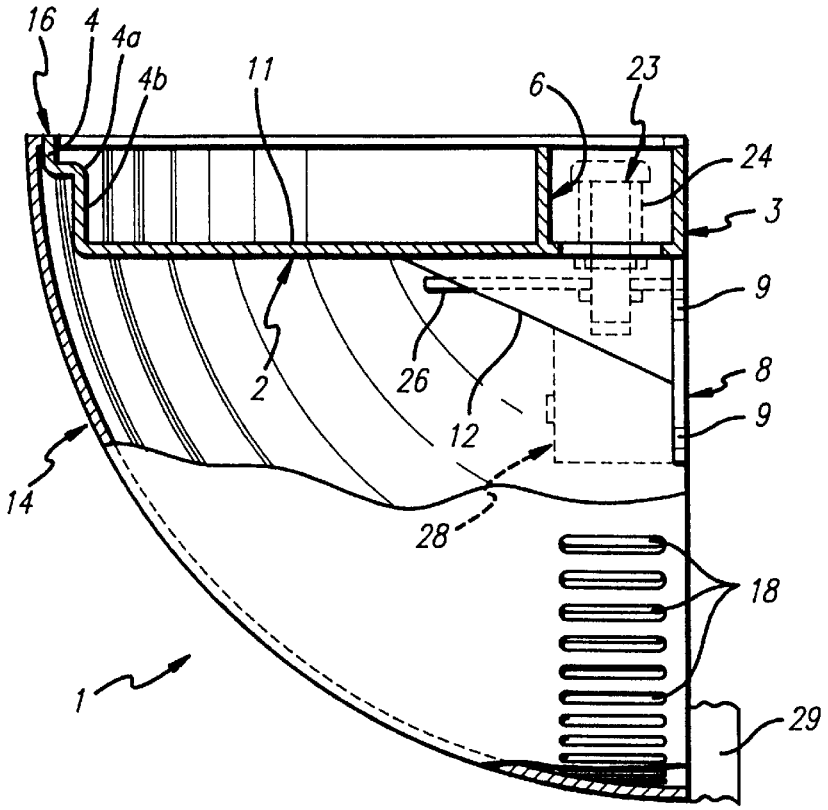
FIG. 3 is a sectional view, taken along line 3—3 of the sconce illustrated in FIG. 1, more particularly detailing the sconce bracket and sconce panel.
Figure 7:
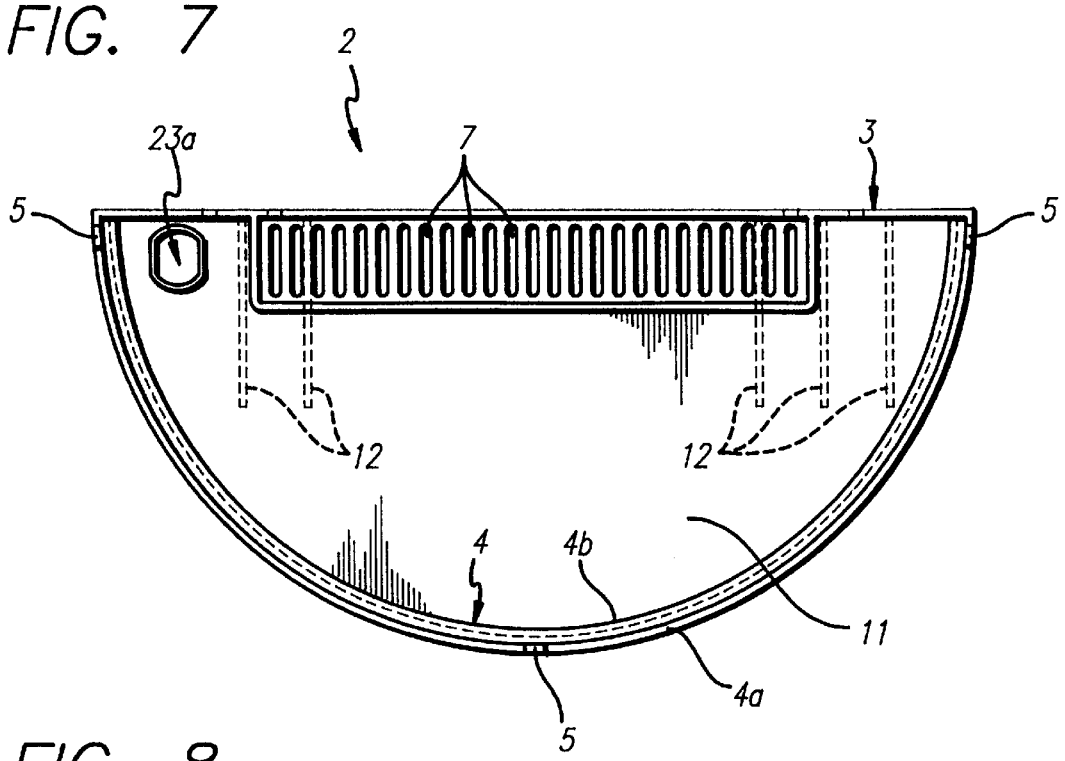
FIG. 7 is a top view of the sconce bracket, further illustrating a locking device mounted in the bracket.
Figure 8:
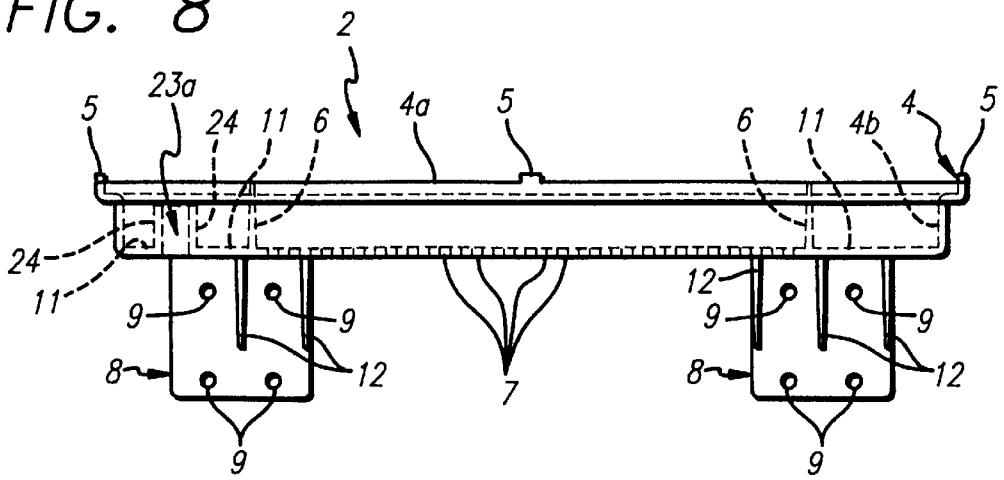
FIG. 8 is a front view of the sconce bracket illustrated in FIG. 7.
Figure 9:
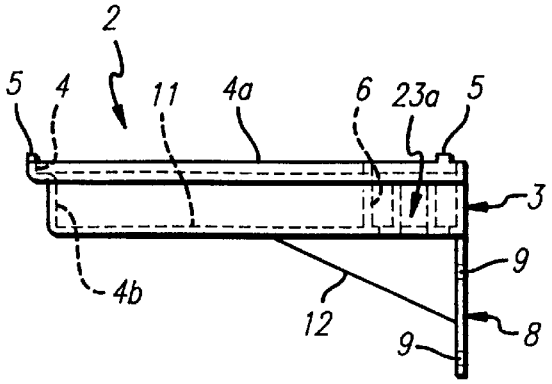
FIG. 9 is a side view of the sconce bracket illustrated in FIGS. 7 and 8.

Referring initially to FIGS. 1–3 and 7–9 of the drawings, in a first preferred embodiment the sconce of this invention is generally illustrated by reference numeral 1. The sconce 1 includes a horizontally-oriented sconce bracket 2, characterized by an elongated, generally rectangular, flat bracket frame 3, having a pair of rectangular frame legs 8 extending perpendicularly downwardly therefrom in spaced relationship with respect to each other. A top curved bracket panel or frame 4, shaped in a horizontally-deployed, substantially semicircular configuration, extends from a corresponding end of the flat bracket frame 3 and projects downwardly at a shoulder 4*a* to define a parallel bottom curved bracket frame 4*b*, as illustrated in FIG. 3. A horizontally-oriented, semicircular frame floor 11, the outer contour of which substantially matches the contour of the flat bracket frame 3 and bottom curved bracket frame 4, terminates the curved bracket 4*b*. Each frame leg 8 includes four vertically-spaced fastener openings 9, for receiving a bolt or fastener (not illustrated) for threading into a wall 29 and mounting the sconce bracket 2 on the wall 29 above a thermostat 28 provided on the wall 29, and illustrated in phantom in FIGS. 2 and 3. Spaced leg gussets or braces 12 fixedly originate on each frame leg 8 and angle upwardly to terminate in or on the frame floor 11. A rectangular vent box 6 incorporates a segment of the frame floor 11 adjacent to the flat bracket frame 3 and spans the multiple vents 7 in the frame floor 11. Three, upward-standing frame tabs 5 are included in the top curved bracket frame 4, two of which frame tabs 5 are located adjacent to a corresponding end of the curved bracket frame 4 adjacent to the flat bracket frame 3 and a third positioned in the center of the top curved bracket frame 4, as illustrated in FIGS. 7–9.

Figure 6:
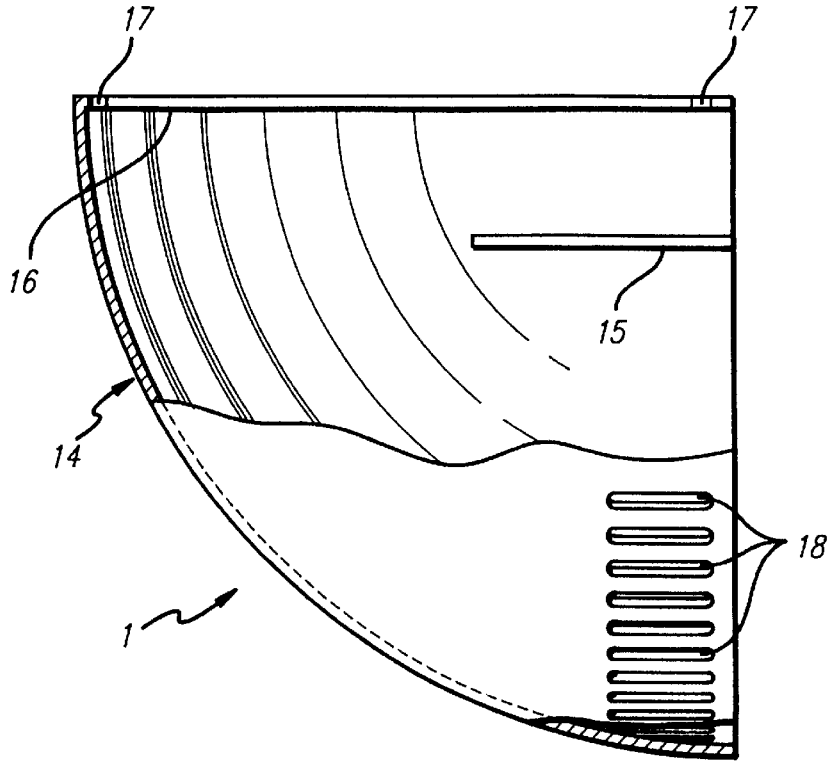
FIG. 6 is a left side view, partially in section, of the sconce panel illustrated in FIGS. 4 and 5, more particularly detailing a preferred vent configuration.
Figure 4:
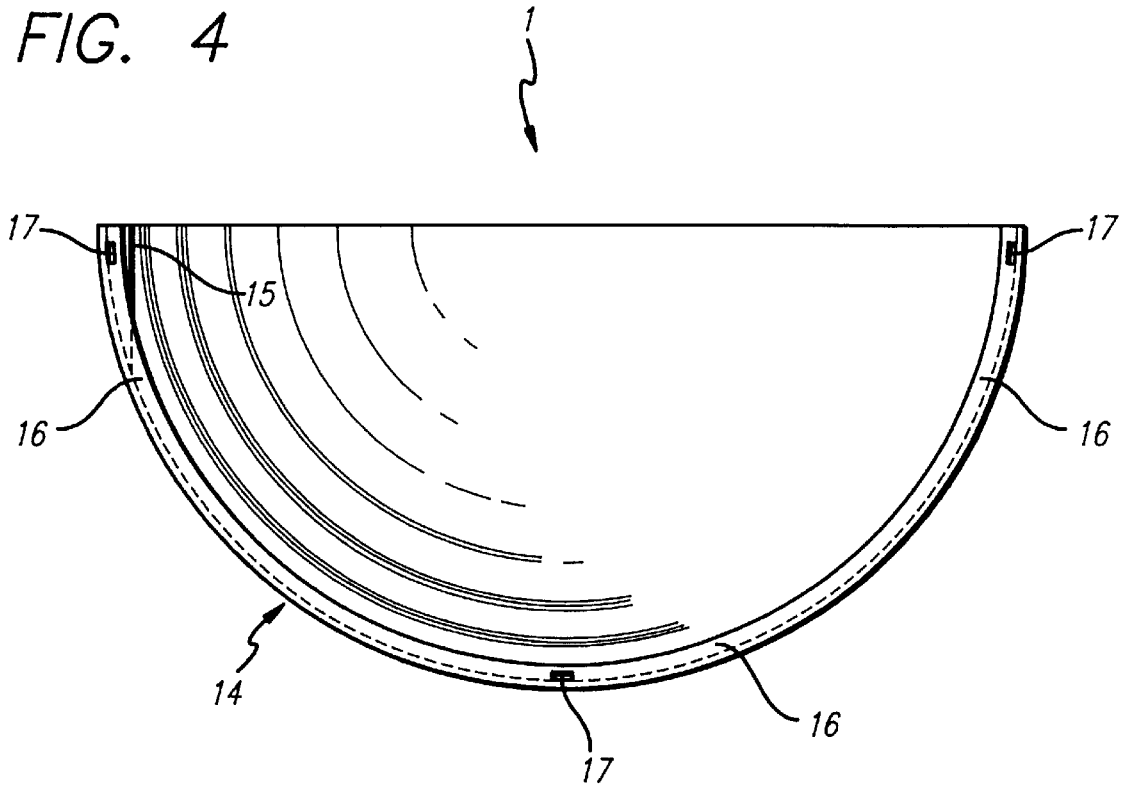
FIG. 4 is a top view of the sconce panel element of the sconce, with vents removed for brevity.
Figure 5:
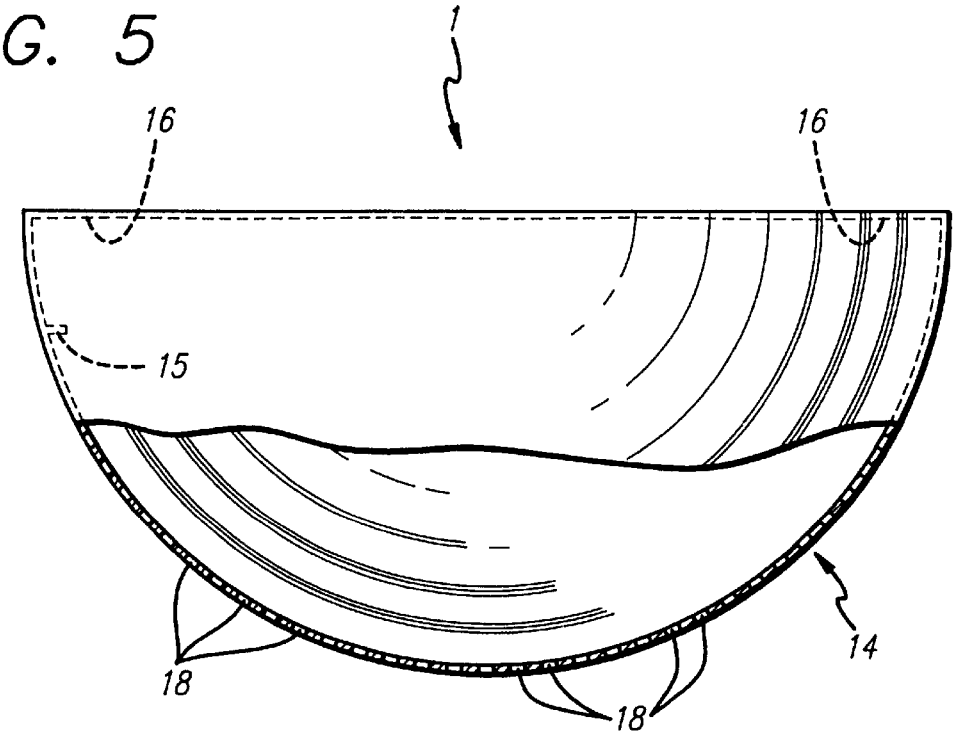
FIG. 5 is a front view, partially in section, of the sconce panel illustrated in FIG. 4, detailing vent spacing.

As illustrated in FIGS. 1–6 a curved sconce panel 14, shaped in the configuration of a hollow quarter sphere, is provided with a panel catch 15, formed in an upper curved edge thereof (FIGS. 4–6). Three panel tab acceptors 17 (FIGS. 4–6) are provided in a curved panel lip 16, one of which panel tab acceptors 17 is located near the panel catch 15. Accordingly, as illustrated in FIGS. 1–3, in mounting the sconce panel 14 on the sconce bracket 2, the panel lip 16 of the sconce panel 14 is aligned with the curved shoulder 4*a* of the top curved bracket frame 4 of the sconce bracket 2. The sconce panel 14 is then adjusted on the bracket frame 4 such that each frame tab 5 engages a corresponding panel tab acceptor 17 and the sconce panel 14 is thusly securely, yet removably, mounted on the sconce bracket 2, abutting the wall 29 and enclosing and concealing the thermostat 28. The sconce panel 14 is provided with multiple panel vents 18 for allowing air to enter the sconce 1 and circulate around the thermostat 28. Air may also enter the sconce 1 through the vent box vents 7 provided in the frame floor 11 of the vent box 6. A decorative object such as a flower arrangement (not illustrated) or the like, may be supported and displayed on the flat frame floor 11 of the sconce 1, as desired.

Referring again to FIGS. 1–3 and 7–9 of the drawings, a lockset 23, characterized by a cylindrical barrel 24, is mounted in a circular lock set opening 23*a* provided in the sconce bracket 2. A keyway 25 for receiving a key (not illustrated) is centrally provided in the barrel 24 and a locking element 26 extends from the end of the barrel 24, selectively under the panel catch 15 of the sconce panel 14, as illustrated in FIG. 2, to optionally lock the sconce panel 14 on the sconce bracket 2. Accordingly, when the sconce panel 14 is mounted on the sconce bracket 2, the locking element 26 is pivotable beneath and away from the panel catch 15, as follows: A key (not illustrated) is inserted in the keyway 25 and rotated such that the lock element 26 engages the panel catch 15 and removably locks the sconce panel 14 on the sconce bracket 2, and the key is then removed. Accordingly, when removal of the sconce panel 14 is desired, the key is again inserted in the keyway 25 and rotated to disengage the lock element 26 from the panel catch 15.

It will be appreciated by those skilled in the art that the sconce 1 of this invention may be mounted on the wall 29 of a room at any desired location for decorative purposes, or to conceal a thermostat 28, or both. The lockset 23 illustrated in FIGS. 6 and 7 may be employed to prevent unauthorized removal of the sconce panel 14 and adjustment of the thermostat 28, as desired. The sconce 1 may also be used to cover wall safes and the like, as desired, and may employ various decorative items such as a picture, as well as flowers and the like, as heretofore described.

Accordingly, while the preferred embodiments of this invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A sconce for mounting on a wall, comprising a bracket having a frame characterized by a flat frame segment for abutting the wall, a rounded frame segment extending from said flat frame segment, bracket air vents provided in said rounded frame segment of said bracket and a rounded, slotted sconce panel removably carried by said rounded frame segment of said bracket, whereby said sconce panel is suspended from said bracket and abuts the wall.

2. The sconce of claim 1 comprising lock means provided in said bracket, said lock means extending through said bracket to said sconce panel for selectively engaging said sconce panel and removably securing said sconce panel to said bracket.

3. The sconce of claim 1 wherein said bracket air vents are substantially horizontally oriented in said rounded frame segment of said bracket for ventilating that area of the wall closed by said bracket and said sconce panel.

4. The sconce of claim 1 comprising lock means provided in said bracket, said lock means extending through said bracket to said sconce panel for selectively engaging said sconce panel and removably securing said sconce panel to said bracket and wherein said bracket air vents are substantially horizontally oriented in said rounded frame segment of said bracket for ventilating that portion of the wall closed by said bracket and said sconce panel.

5. The sconce of claim 1 comprising panel air vents provided in said sconce panel for ventilating that area of the wall closed by said bracket and said sconce panel.

6. The sconce of claim 1 wherein said bracket air vents are substantially horizontally oriented in said rounded frame segment of said bracket and comprising panel air vents provided in said sconce panel for ventilating that area of the wall closed by said bracket and said sconce panel.

7. The sconce of claim 6 comprising a lockset provided in said bracket said lockset extending through said bracket to said sconce panel for selectively engaging said sconce panel and removably securing said sconce panel to said bracket.

8. The sconce of claim 1 comprising a vent box provided in said rounded frame segment of said bracket, a floor provided in said vent box and bracket air vents provided in said floor and wherein said sconce panel engages said rounded frame segment of said bracket adjacent to said frame floor.

9. The sconce of claim 8 comprising a lockset provided in said bracket, said lockset extending through said bracket to said sconce panel for selectively engaging said sconce panel and removably securing said sconce panel to said bracket.

10. The sconce of claim 8 wherein said floor and said bracket air vents provided in said bracket for ventilating that area of the wall closed by said bracket means and said sconce panel, are substantially horizontally oriented.

11. The sconce of claim 8 comprising panel air vents provided in said sconce panel for ventilating that area of the wall closed by said bracket and said sconce panel.

12. The sconce of claim 8 wherein said floor and said bracket air vents provided in said bracket means and panel air vents provided in said sconce panel for ventilating that area of the wall closed by said bracket means and said sconce panel, are substantially horizontally oriented and comprising panel air vents provided in said sconce panel for ventilating that area of the wall closed by said bracket and said sconce panel.

13. The sconce of claim 12 comprising a lockset provided in said bracket, said lockset extending through said bracket to said sconce panel, for selectively engaging said sconce panel and removably securing said sconce panel to said bracket.

14. A sconce for mounting on a wall and concealing a wall-mounted thermostat, comprising a sconce bracket characterized by a frame attached to the wall adjacent to the thermostat; a vent box provided in said frame; at least one air vent provided in said vent box for circulating air to the thermostat; a rounded sconce panel removably mounted on said bracket for concealing the thermostat; and panel air vents provided in said sconce panel for ventilating the thermostat.

15. The sconce of claim 14 comprising a floor recessed in said vent box and wherein said air vent is provided in said floor.

16. The sconce of claim 14 comprising a lockset provided in said bracket, said lockset extending through said bracket to said sconce panel and selectively engaging said sconce panel for removably securing said sconce panel to said bracket.

17. The sconce of claim 14 wherein said at least one air vent provided in said vent box comprises a plurality of air vents for further ventilating the thermostat and comprising a lockset provided in said bracket, said lockset extending through said bracket to said sconce panel and selectively engaging said sconce panel, for removably securing said sconce panel to said bracket.

18. The sconce of claim 15 wherein said floor is substantially horizontally oriented through said vent box of said bracket and wherein said sconce panel engages said bracket adjacent to said floor.

19. The sconce of claim 18 wherein said at least one air vent provided in said vent box comprises a plurality of air vents for further ventilating the thermostat.

20. The sconce of claim 19 comprising a lockset provided in said bracket, said lockset extending through said bracket to said sconce panel and selectively engaging said sconce panel for removably securing said sconce panel to said bracket.

* * * * *